United States Patent [19]

Garnett et al.

[11] 4,401,688

[45] Aug. 30, 1983

[54] IMPARTING PERMANENT PRESS CHARACTERISTICS

[75] Inventors: John L. Garnett, Longueville; Thomas Schwarz, Rose Bay; Grant Fletcher, Maroubra, all of Australia

[73] Assignee: Unisearch Limited (N.S.W.)Australia, Kensington, Australia

[21] Appl. No.: 252,132

[22] Filed: Apr. 8, 1981

Related U.S. Application Data

[63] Continuation of Ser. No. 74,120, Sep. 10, 1979, abandoned.

[30] Foreign Application Priority Data

Sep. 11, 1978 [AU] Australia ..... PD5888

[51] Int. Cl.[3] ..... B05D 3/06

[52] U.S. Cl. ..... 427/43.1; 427/44; 427/54.1; 427/370; 427/393.2

[58] Field of Search ..... 427/54.1, 44, 390 C, 427/43.1, 393.2, 355, 370

[56] References Cited

U.S. PATENT DOCUMENTS

| | | | |
|---|---|---|---|
| 2,413,973 | 1/1947 | Howk | 427/44 |
| 2,684,305 | 7/1954 | Quinlivan | 427/54.1 |
| 2,872,428 | 2/1959 | Schroeder | 427/393.2 |
| 3,606,993 | 9/1971 | Arthur et al. | 427/44 |
| 3,632,391 | 1/1972 | Whitfield et al. | 427/393.2 |
| 3,652,212 | 3/1972 | Macheil | 427/44 |
| 3,702,231 | 11/1972 | Dale | 427/44 |
| 4,116,625 | 9/1978 | Yamamoto | 427/393.2 |

*Primary Examiner*—John D. Smith
*Assistant Examiner*—Janyce A. Bell
*Attorney, Agent, or Firm*—Michael J. Striker

[57] ABSTRACT

The method for imparting permanent press characteristics to textile articles without using textile resins and textile resin catalysts includes applying to the textile article, a urethane acrylate prepolymer or an epoxy acrylate prepolymer or an acrylated polyester prepolymer or a water soluble monomer having a molecular weight less than 300 and selected from the group comprising acrylic acid, methacrylic acid, esters and substituted esters of acrylic acid and methacrylic acid and amides of acrylic acid and methacrylic acid, or prepolymers of such monomers, curing the prepolymer or monomer in situ on the textile article using ultraviolet radiation, and pressing the textile article along a crease after the application of the prepolymer or monomer. The pressing step may be applied either before or after the curing of the prepolymer or monomer.

9 Claims, No Drawings

IMPARTING PERMANENT PRESS CHARACTERISTICS

This is a continuation of application Ser. No. 074,120, filed Sept. 10, 1979, now abandoned.

BACKGROUND OF THE INVENTION

The present invention relates to a method for imparting permanent press characteristics to textile articles and more particularly relates to a process wherein the permanent press characteristics are obtained by applying to the textile article an ultra-violet or electron beam radiation curable monomer or prepolymer.

Permanent press characteristics have long been sought for textile articles to enable a crease to be applied to a textile article, particularly to articles of clothing, in such a way that the crease will remain in the textile article despite use or washing of the article. Currently available methods for imparting permanent press characteristics have been only partially successful.

SUMMARY OF THE INVENTION

The present invention is directed to the provision of an improved method for imparting permanent press characteristics to textile articles in a way which may be carried out rapidly and economically.

The present invention consists in a method for imparting permanent press characteristics to textile articles comprising the steps of:

(a) Applying to the textile article, at least in the area to be creased and pressed, a urethane acrylate prepolymer or an epoxy acrylate prepolymer or an acrylated polyester prepolymer or a water soluble monomer having a molecular weight less than 300 and selected from the group comprising acrylic acid; methacrylic acid; substiuted acrylic and methacrylic acids; esters and substituted esters of acrylic acid and methacrylic acid; and amides and substituted amides of acrylic acid and methacrylic acid; or prepolymers of such monomers, (b) Curing the monomer or prepolymer in situ on the textile article using ultra-violet radiation or an electron beam, and (c) Pressing the textile article along a crease after the application of the monomer or prepolymer and either before or after the curing of the monomer or prepolymer.

DETAILED DESCRIPTION OF THE INVENTION

The textile articles to which the present process may be applied comprise woven, knitted, or felted textile articles which are preferably formed from polyester, nylon or cotton fibres. Fibres of viscose or wool may also be used.

The water soluble monomers which may be used in carrying out this process are monomers having a molecular weight of less than 300 which are selected from the group comprising acrylic acid; methacrylic acid; substituted acrylic and methacrylic acids; esters and substituted esters of acrylic acid and methacrylic acid; and amides and substituted amides of acrylic and methacrylic acids. Any suitable substituents may be present in the substituted acids, esters or amides provided that the substituents do not detract from the solubility of the monomers and do not increase the molecular weight of the monomer to more than 300. The molecular weight of the monomers is preferably less than 200, most preferably less than 150. Monomers which are preferred in the present process include acrylic acid, diethylamino ethylmethacrylate, hydroxy ethyl acrylate, hydroxy propyl acrylate, N-methylol acrylamide, diethyl amino ethyl acrylate and 2-hydroxy ethyl methacrylate. Of these diethylamino ethyl-methacrylate has been found to give the best permanent press characteristics to textile articles. In determining the monomers which may be used in carrying out the present invention the expression water soluble is taken to mean a monomer which can form a saturated solution in water at room temperature which contains at least 10% by weight of the monomer.

The monomers are preferably, though not necessarily, applied to the textile articles from solution. The solvent for the monomer is preferably water or a lower alcohol or a mixture thereof. The solvent is preferably selected to swell the fibres of the textile articles to which the monomer is to be applied to the maximum extent. The solvent should therefore be selected according to its ability to swell the fibres of the textile article. The monomer may be present in an amount of 5 to 50% by volume of the solution, however, it is preferred to have from 20 to 40% by volume of the monomer in the solution. The amount of solution to be applied per unit area of textile articles will depend upon the concentration of monomer in the solution, the particular monomer selected, the particular solvent selected, and the nature of the textile article itself. Simple experimentation will reveal the most suitable rate of application of the monomer solution, however, typical application rates are set out in the examples in this specification.

The prepolymers which may be used in the method according to the present invention are prepolymers formed by the ionising radiation or ultra-violet polymerisation of urethane acrylates or epoxy acrylates, acrylated polyester or mixtures thereof. These prepolymers may be used in a solvent free system or alternatively may be dissolved in any compatible solvent such as acetone or benzene. If the prepolymers are formed into solutions it is preferred that the solution contain from 5 to 50% of the prepolymer by volume while from 15 to 30% by volume of the prepolymer in the solvent is preferred.

In the formation of a prepolymer a monomer of the desired type is caused to polymerise to a partial but incomplete degree using ionising radiation or ultra-violet radiation. The prepolymers formed show a capacity to rapidly cure when subjected to further radiation.

When the textile fabric is treated with a monomer or a mixture of monomer it is advantageous to add an unsaturated polyester to the monomer prior to the application of the monomer to the textile. The polyester may be added to the monomer in an amount of up to its maximum solubility in the monomer. The unsaturated polyesters are particularly soluble in esters of acrylic and methacrylic acid, particularly methyl methacrylate.

In order to improve the rapidity of the U.V. cure of the monomer or prepolymer applied to the textile article it is preferred that the monomer solution or the prepolymer or prepolymer solution contains from 1 to 10% , preferably 2 to 3%, weight to volume, of benzoin ethyl ether or another suitable sensitiser. The monomer solution or the prepolymer solution may be applied to the textile article by any suitable technique such as by use of a roller, or by dipping or spraying.

In order to cure the monomer or prepolymer in situ on the textile article, the article to which the monomer or prepolymer has been applied is subjected to ultra-violet or electron beam radiation until the monomer or prepolymer has been completely cured. In a typical example cure times of one minute were obtained with a 200 watt per inch Hanovia lamp situated 10 cm from the textile article. These cure times were obtained with an unfocused lamp, however, using a similar lamp suitable focussed cure times of from 1/5 to $\frac{1}{3}$ of a second were obtained. The certainty of the cure may be attested by observing the rigidity of the crease formed in the textile article. It is preferred that the whole face of the textile article to which the monomer or prepolymer has been applied is subjected to ultra-violet or electron beam radiation. In certain circumstances it is possible to obtain adequate permanent press characteristics when the ultra-violet light or electron beam is applied to the textile article only on one side of the crease formed in the textile article.

The permanent press is preferably obtained by bending the textile article after the monomer or prepolymer has been applied to it in the area of the textile article to which the monomer or prepolymer was applied and then ironing a crease into the textile article using a warm to hot iron or some similar means such as a steam pressing device or the like. The formation of the permanent press in the textile article may take place either before or after the curing of the monomer or prepolymer.

The method according to the present invention was found in many cases to impart abrasion resistance and other related properties in addition to the permanent press properties described above. In addition it was found that certain monomers and polymers when applied particularly to cotton and polyester textile articles improved the retardency to flamability of the textile articles.

In the following examples the specified monomers or prepolymers in the defined solvents were applied to textile samples $2\frac{1}{4}$ inches by $1\frac{1}{4}$ inches. The samples were subjected to Soxhlet extracted in carbon tetrachloride overnight, were dried and conditioned for at least 12 hours at 65% relative humidity and then weighed.

Unless otherwise indicated benzoin ethyl ether (3% w/v monomer solution) was added to the solution of monomer or prepolymer which was then coated onto the textile article by spraying. To impart permanent press characteristics the textile sample was folded and placed in a cardboard holder exposing a 1 inch by $\frac{1}{8}$ inch fold. The monomer or prepolymer solution was then applied to the fold. The sample was removed and placed between a fibreglass belt and a heat resistant pad. A crease was then formed using a warm-hot iron which was passed over the sample several times with light hand pressure. The creased samples were then cured either with U.V. radiation or an electron beam. In the U.V. case the samples were exposed to a 200 watt/inch Hanovia U.V. lamp for two minutes until the crease was rigid. The article was then turned over and then re-exposed to the U.V. lamp for a further two minutes. After curing the samples were conditioned at 65% relative humidity for 12 hours, then Soxhlet extracted with carbon tetrachloride for 48 hours followed by benzene extraction for 48 hours. The samples were then dried, conditioned and weighed.

It will be noted that while solutions of the monomer and prepolymer were predominantly used in the examples in order to facilitate the spraying of the prepolymers onto the textile samples it is possible to carry out the process according to the present invention using the defined monomers and prepolymers without the use of solvents.

Table 1 shows the treatment of wool with 0.4 ml aliquots of a series of monomers in solution. The monomers being present in a solution containing 40% by volume methanol and 60% water. The percentage of monomer in the solution is shown in the column headed "%V/V Soln." The percentage weight gain of the textile article after U.V. curing is shown in the column headed "Co-polymer after U.V. (%weight gain)". The proportion of the "graft" of the polymer lost following the extraction in carbon tetrachloride is shown in the column headed "Polymer Lost (CCL4) % by weight" while the proportion lost following the benzene extraction is shown in the column headed "Polymer Loss (benzene) % by weight".

It should be noted that Example 17 and 18 in Table 1 are given by way of comparison. It will be noted with these examples which do not fall within the scope of the present invention that a high proportion of the monomer which appeared to have been grafted to the textile sample was lost during the benzene extraction.

TABLE 1

| | Monomer | % V/V Soln | Copolymer After U.V. (%) (Weight gain) | Polymer Lost ($CCl_4$) (by weight) | Polymer Lost (benzene) (by weight) |
|---|---|---|---|---|---|
| 1. | Acrylic Acid | 20 | 44 | 0 | 0 |
| 2. | Acrylic Acid | 30 | 67 | 0 | 0 |
| 3. | Methacrylic acid | 20 | 37 | 0 | 0 |
| 4. | Methacrylic acid | 30 | 48 | 0 | 0 |
| 5. | Diethylamino ethyl-methacrylate | 10 | 4 | 0 | −1 |
| 6. | Diethylamino ethyl-methacrylate | 20 | 11 | −2 | −9 |
| 7. | Diethylamino ethyl-methacrylate | 30 | 11 | −3 | −4 |
| 8. | Hydroxy ethyl acrylate | 20 | 40 | 0 | 0 |
| 9. | Hydroxy ethyl acrylate | 30 | 78 | 0 | 0 |
| 10. | Hydroxy ethyl acrylate | 40 | 64 | 0 | 0 |
| 11. | Hydroxy propyl acrylate | 20 | 39 | 0 | 0 |
| 12. | Hydroxy propyl acrylate | 30 | 53 | 0 | 0 |

TABLE 1-continued

| | Monomer | % V/V Soln | Copolymer After U.V. (%) (Weight gain) | Polymer Lost ($CCl_4$) (by weight) | Polymer Lost (benzene) (by weight) |
|---|---|---|---|---|---|
| 13. | Hydroxy propyl acrylate | 40 | 68 | 0 | −1 |
| 14. | Hydroxy ethyl methacrylate | 20 | 39 | 0 | 0 |
| 15. | Hydroxy ethyl methacrylate | 30 | 67 | 0 | 0 |
| 16. | Hydroxy ethyl methacrylate | 40 | 79 | 0 | 0 |
| 17. | Vinyl pyrrolidone | 20 | 42 | 0 | −30 |
| 18. | Vinyl pyrrolidone | 30 | 44 | 0 | −23 |

Table 2 shows the effect of grafting 0.5 ml aliquots of the same monomer solutions as were described in Table 1 onto cotton textile samples. In this case it was found that comparative examples 17 and 18 not only suffered from a loss of "grafted monomer" during the benzene extraction but that also the textile sample was severely weakened by the process.

TABLE 2

| | Monomer | % V/V Soln | Copolymer After U.V. (%) (Weight gain) | Polymer lost ($CCl_4$) % | Polymer Lost (benzene) % |
|---|---|---|---|---|---|
| 1. | Acrylic Acid | 20 | 69 | −3 | 0 |
| 2. | Acrylic acid | 30 | 63 | 0 | 0 |
| 3. | Methacrylic acid | 20 | 28 | 0 | 0 |
| 4. | Methacrylic acid | 30 | 46 | 0 | 0 |
| 5. | Diethylamino ethyl-methacrylate | 10 | 3 | −1 | −1 |
| 6. | Diethylamino ethyl-methacrylate | 20 | 9 | −5 | −2 |
| 7. | Diethylamino ethyl-methacrylate | 30 | 12 | −5 | −2 |
| 8. | Hydroxy ethyl acrylate | 20 | 48 | 0 | 0 |
| 9. | Hydroxy ethyl acrylate | 30 | 69 | 0 | 0 |
| 10. | Hydroxy ethyl acrylate | 40 | 87 | 0 | 0 |
| 11. | hydroxy propyl acrylate | 20 | 41 | 0 | 0 |
| 12. | hydroxy propyl acrylate | 30 | 62 | 0 | −1 |
| 13. | hydroxy propyl acrylate | 40 | 70 | 0 | −2 |
| 14. | Hydroxy ethyl methacrylate | 20 | 39 | 0 | −2 |
| 15. | Hydroxy ethyl methacrylate | 30 | 55 | 0 | 0 |
| 16. | Hydroxy ethyl methacrylate | 40 | 77 | 0 | −10 |
| 17. | Vinyl pyrrolidone | 20 | 38 | 0 | −20 |
| 18. | Vinyl pyrrolidone | 30 | 60 | 0 | −20 |

In the examples shown in Table 3 the examples described with reference to Tables 1 and 2 were repeated on samples of polyester textile with the exception that the solvent was 50% methanol and 50% water. Aliquots of from 0.3 to 0.4 mls were applied to the textile test samples. Again it was found that the comparative examples 17 and 18 were subjected to substantial weight loss following benzene extraction.

TABLE 3

SAMPLE: POLYESTERS

| | Monomer | % (V/V) | Polymer up take after Curing (%) | Polymer lost After $CCl_4$ (%) | Polymer lost after Benzene wash (%) |
|---|---|---|---|---|---|
| 1. | Acrylic Acid | 20 | 41 | 0 | 0 |
| 2. | Acrylic Acid | 30 | 52 | 0 | −1 |
| 3. | Methacrylic Acid | 20 | 32 | 0 | 0 |
| 4. | Methacrylic Acid | 30 | 40 | 0 | 0 |
| 5. | Diethylamino ethyl methacrylate | 20 | 15 | −2 | −6 |
| 6. | Diethylamino ethyl methacrylate | 30 | 14 | 2 | −4 |
| 7. | Hydroxy ethyl Acrylate | 20 | 38 | 0 | −1 |
| 8. | Hydroxy ethyl Acrylate | 30 | 61 | 0 | −1 |
| 9. | Hydroxy propyl Acrylate | 20 | 33 | −1 | −1 |

TABLE 3-continued

| | Monomer | % (V/V) | Polymer up take after Curing (%) | Polymer lost After $CCl_4$ (%) | Polymer lost after Benzene wash (%) |
|---|---|---|---|---|---|
| | SAMPLE: POLYESTERS | | | | |
| 10. | Hydroxy propyl Acrylate | 30 | 39 | −1 | −1 |
| 11. | Hydroxy ethyl methacrylate | 20 | 33 | −1 | −1 |
| 12. | Hydroxy ethyl methacrylate | 30 | 49 | 0 | −2 |
| 13. | N—methylol Acrylamide | 20 | 16 | 0 | −2 |
| 14. | N—methylol Acrylamide | 30 | 28 | −1 | −2 |

Table 4, 5 and 6 show the grafting of monomers to wool cotton and polyester samples ($2\frac{1}{4}$ by $1\frac{1}{4}$ inches) respectively. From 0.2 to 0.3 mls of monomer or monomer solution were applied to each textile sample. The monomer or monomer solution contained from 3 to 5% of benzoin ethyl ether as a photosensitizer. All samples were cured for two minutes on each side under a 1200 U.V. lamp, were then extracted for 24 hours with carbon tetrachloride and were conditioned for 24 hours at 65% relative humidity before weighing. The monomers in examples 1 to 6 of each of the Tables were neat monomers according to the present invention. Examples in Examples 7 to 10 are methanol solutions of monomers which fall outside the scope of the present invention because they are either not acrylates or methacrylates or because they are not water soluble. It will be noted that there is a consistently poorer performance from the examples falling outside the scope of the present invention than there is in respect of those falling within the scope of the present invention.

TABLE 4

| | | WOOL | |
|---|---|---|---|
| | | Polymer Up Take After Curing (% by weight) | Polymer lost After $CCl_4$ (% by weight) |
| 1. | Acrylic Acid | 4.2 | 0 |
| 2. | Methacrylic Acid | 21.9 | −1 |
| 3. | Diethylamino ethyl methacrylate | 19.1 | −14 |
| 4. | Hydroxy ethyl Acrylate | 124.7 | 0 |
| 5. | Hydroxy propyl Acrylate | 32.0 | −0.5 |
| 6. | Hydroxy ethyl methacrylate | 36.5 | −31 |
| 7. | Methyl methacrylate | 1.6 | 0 |
| 8. | Ethyl acrylate | 1.4 | 0 |
| 9. | Butyl acrylate | 6.8 | −3 |
| 10. | Styrene | 1.7 | 0 |

TABLE 5

| | | COTTON | |
|---|---|---|---|
| | | Polymer up take after curing (% by weight) | Polymer lost after $CCl_4$ (% by weight) |
| 1. | Acrylic Acid | 3.1 | 0 |
| 2. | Methacrylic Acid | 131.6 | 0 |
| 3. | Diethylamino ethyl methacrylate | 17.2 | −10 |
| 4. | Hydroxy ethyl Acrylate | 67.8 | 0 |
| 5. | Hydroxy propyl Acrylate | 56.8 | 0 |
| 6. | Hydroxy ethyl methacrylate | 30.8 | −13.0 |
| 7. | Methyl methacrylate | 1.2 | −0.3 |
| 8. | Ethyl acrylate | 1.0 | −0.1 |
| 9. | Butyl acrylate | 8.0 | −6.7 |
| 10. | Styrene | 1.1 | 0 |

TABLE 6

| | | POLYESTER | |
|---|---|---|---|
| | | Polymer up take after curing (% by weight) | Polymer lost after $CCl_4$ (% by weight) |
| 1. | Acrylic Acid | 1.3 | 0 |
| 2. | Methacrylic Acid | 15.2 | 0 |
| 3. | Diethylamino ethyl methacrylate | 28.5 | −24 |
| 4. | Hydroxy ethyl Acrylate | 61.3 | 0 |
| 5. | Hydroxy propyl Acrylate | 32.7 | 0 |
| 6. | Hydroxy ethyl methacrylate | 18.4 | 0 |
| 7. | Methyl methacrylate | 0 | 0 |
| 8. | Ethyl acrylate | 0 | 0 |
| 9. | Butyl acrylate | 10.3 | −10 |
| 10. | Styrene | 0 | 0 |

Tables 7, 8 and 9 show the grafting of prepolymers to samples respectively of wool, cotton and polyester by the method according to the present invention. All of the samples treated by the process described with reference to Tables 7, 8 and 9 showed excellent permanent press characteristics.

TABLE 7

| | PREPOLYMERS ON WOOL - U.V. CURE | | | | |
|---|---|---|---|---|---|
| | | % Polymerisation | Polymer lost ($CCl_4$ %) | Polymer lost (Benzene %) | Polymer lost after Soxhlet extraction with water for 10 hours |
| 1. | Melamine Acrylate (DAUBERT Chemical Co.) | 16 | 0 | −1 | −6 |
| 2. | Epoxy Acrylate (DH304, Shell Chemical Co.) | 22 | −2 | −1 | |
| 3. | Epoxy Acrylate (DOWEX 80, Dow Chemical Co.) | 28 | -5 | −2 | |

TABLE 7-continued

PREPOLYMERS ON WOOL - U.V. CURE

| | | % Polymerisation | Polymer lost ($CCl_4$ %) | Polymer lost (Benzene %) | Polymer lost after Soxhlet extraction with water for 10 hours |
|---|---|---|---|---|---|
| 4. | Urethane Acrylate of linseed Alkyl (Celanese Corp. applications bulletin for Urethane Acrylate manufacture) | 16 | 0 | −2 | −3 |
| 5. | Urethane Acrylate of polyester triol (as above) | 9 | −4 | −3 | |
| 6. | Urethane Acrylate of polyester resin (as above) | 20 | −9 | −2 | |
| 7. | Urethane Oil | 17 | −15 | −2 | |
| 8. | ZL 788 Urethane acrylate (Thiokol Corp.) | 12 | 0 | −3 | |
| 9. | ZL 788 (20%) + Butyl Acrylate Prepolymer (80%) | 20 | −9 | −2 | |
| 10. | Unsaturated Urethane (U-0100 Witco Chemical Co.) | 30 | −7 | −2 | −3 |
| 11. | Uvithane 782 } Polychrome Corp. | 17 | −3 | −2 | |
| 12. | Uvithane 783 } Polychrome Corp. | 17 | −1 | −2 | −3 |
| 13. | Chempol 19-4827 } Freeman Corp. | 26 | −5 | −1 | |
| 14. | Chempol XR-19-962-37 } Freeman Corp. | 0.5 | −0.5 | — | |
| 15. | Chempol 19-4832 } Freeman Corp. | 36 | −2 | −2 | −6 |
| 16. | Urethane Acrylic Acid 166 "Purelast" | 34 | −29 | −4 | |
| 17. | Urethane Acrylic Acid 176 } Polymer Systems Corp. | 40 | −15 | −1 | |
| 18. | Urethane Acrylic Acid 186 } Polymer Systems Corp. | 28 | −5 | −1 | −4 |
| 19. | Urethane Acrylic Acid 190 } Polymer Systems Corp. | 30 | −5 | −1 | |

TABLE 8

PREPOLYMERS ON COTTON - U.V. CURE

| | | % Polymerisation | Polymer lost ($CCl_4$ %) | Polymer lost (Benzene %) | Polymer lost after Soxhlet extraction with water for 10 hours |
|---|---|---|---|---|---|
| 1. | Melamine Acrylate (DAUBERT Chemical Co.) | 12 | 0 | −2 | −5 |
| 2. | Epoxy Acrylate (DH304, Shell Chemical Co.) | 19 | 0 | 0 | |
| 3. | Epoxy Acrylate (DOWEX 80, Dow Chemical Co.) | 25 | −6 | 0 | |
| 4. | Urethane Acrylate of linseed Alkyl (Celanese Corp. applications bulletin for Urethane Acrylate manufacture) | 15 | −1 | 0 | |
| 5. | Urethane Acrylate of polyester triol (as above) | 9 | −2 | −1 | −4 |
| 6. | Urethane Acrylate of polyester resin (as above) | 15 | −6 | 0 | |
| 7. | Urethane Oil | 13 | −12 | 0 | |
| 8. | ZL 788 Urethane acrylate (Thiokol Corp.) | 8 | −1 | −1 | |
| 9. | ZL 788 (20%) + Butyl Acrylate Prepolymer (80%) | 19 | −9 | 0 | |
| 10. | Unsaturated Urethane (U-0100 Witco Chemical Co.) | 25 | −8 | −1 | −3 |
| 11. | Uvithane 782 } Polychrome Corp. | 12 | −2 | −1 | |
| 12. | Uvithane 783 } Polychrome Corp. | 14 | −1 | 0 | −5 |
| 13. | Chempol 19-4827 } Freeman Corp. | 19 | −4 | −2 | |
| 14. | Chempol XF-10-962-37 } Freeman Corp. | 0 | 0 | −1 | |
| 15. | Chempol 19-4832 } Freeman Corp. | 25 | 0 | 0 | −7 |
| 16. | Urethane Acrylic Acid 166 "Purelast" | 26 | −22 | −1 | |
| 17. | Urethane Acrylic Acid 176 } Polymer Systems Corp. | 32 | −16 | −1 | |
| 18. | Urethane Acrylic Acid 186 } Polymer Systems Corp. | 29 | −9 | −1 | −3 |
| 19. | Urethane Acrylic Acid 190 } Polymer Systems Corp. | 20 | −5 | −1 | |

TABLE 9

PREPOLYMERS ON POLYESTER - U.V. CURE
Sample: Polyester

| | | % Polymerisation | Polymer lost ($CCl_4$ %) | Polymer lost (Benzene %) | Polymer lost after Soxhlet extraction with water for 10 hours |
|---|---|---|---|---|---|
| 1. | Melamine Acrylate (DAUBERT Chemical Co.) | 18 | −1 | −1 | |
| 2. | Epoxy Acrylate (DH304, Shell Chemical Co.) | 19 | −1 | 0 | |
| 3. | Epoxy Acrylate (DOWEX 80, Dow Chemical Co.) | 26 | −4 | 0 | |
| 4. | Urethane Acrylate of linseed Alkyl (Celanese Corp. applications bulletin for Urethane Acrylate manufacture) | 17 | −3 | 0 | |
| 5. | Urethane Acrylate of polyester triol (as above) | 8 | −4 | 0 | −1 |
| 6. | Urethane Acrylate of polyester resin (as above) | 23 | −10 | −2 | |
| 7. | Urethane Oil | 19 | −19 | 0 | |
| 8. | ZL 788 Urethane acrylate (Thiokol Corp.) | 38 | −25 | −2 | |
| 9. | ZL 788 (20%) + Butyl Acrylate Prepolymer (80%) | 19 | −10 | −1 | |
| 10. | Unsaturated Urethane (U-0100 Witco Chemical Co.) | 26 | −15 | 0 | 0 |
| 11. | Uvithane 782 } Polychrome Corp. | 23 | −5 | −1 | |
| 12. | Uvithane 783 } Polychrome Corp. | 15 | −2 | −1 | −1 |
| 13. | Chempol 19-4827 } Freeman Corp. "Purelast" Polymer Systems Corp. | 34 | −4 | −1 | |
| 14. | Chempol XR-10-962-37 } Freeman Corp. "Purelast" Polymer Systems Corp. | 0 | 0 | 0 | |
| 15. | Chempol 19-4832 } Freeman Corp. "Purelast" Polymer Systems Corp. | 43 | −3 | −2 | −2 |
| 16. | Urethane Acrylic Acid 168 } Freeman Corp. "Purelast" Polymer Systems Corp. | 42 | −33 | −2 | |
| 17. | Urethane Acrylic Acid 176 } Freeman Corp. "Purelast" Polymer Systems Corp. | 39 | −13 | −1 | |
| 18. | Urethane Acrylic Acid 186 } Freeman Corp. "Purelast" Polymer Systems Corp. | 31 | −6 | −1 | −1 |
| 19. | Urethane Acrylic Acid 190 } Freeman Corp. "Purelast" Polymer Systems Corp. | 29 | −5 | −1 | |

The following tables show the use of a 1 MeV Van De Graaff electron beam facility to bring about curing of a variety of monomers and prepolymers on a variety of substrates.

Tables 10 to 13 respectively show the grafting of monomers and a prepolymer onto wool, cotton, polyester, and nylon. A radiation dose of 5 M Rad was used in all cases except the comparative tests in which no irradiation dose was given at all.

It will be noted that in the case of the monomers a proportion of the weight take up was removed by the extraction with a warm (50° C.) detergent solution. It has been found that in general the higher the molecular weight of the monomer the less likely it is that the polymer of that monomer taken up by the substrate will be removed in hot aqueous solutions. The amount of the up taken polymer removed by aqueous solution does also appear to depend upon the substrate. Wool appears to loose from 10 to 20% by weight of the polymer taken up when boiled for an hour however up to 40 to 50% by weight will be lost after boiling for 10 hours in a Soxhlet extractor. Far lesser levels of weight loss have been observed with cotton and polyester substrates. The higher weight loss from the wool appears to be due to a degradation of the wool structure.

TABLE 10

Wool - 5M Rad E.B. irradiation

| | Monomer | weight gain after E.B. and $CCl_4$ extraction (% by weight) | % weight after benzene extraction | % weight after warm detergent extraction |
|---|---|---|---|---|
| 1. | Acrylic Acid | 57 | 53 | 39 |
| 2. | Acrylic acid with B.E.E. (3%) | 58 | 54 | 48 |
| 3. | Acrylic acid with B.E.E. (3%) no E.B. treatment | 30 | 29 | 10 |
| 4. | Acrylic acid B.E.E. (5%) pressed prior to expoure | 61 | 57 | 45 |
| 5. | 2 hydroxy ethyl acrylate | 48 | 46 | 45 |
| 6. | 2 hydroxy ethyl acrylate with B.E.E. (3%) | 49 | 47 | 46 |
| 7. | 2 hydroxy ethyl acrylate with B.E.E. (3%) no E.B. treatment | 26 | 24 | 11 |
| 8. | 2 hydroxy ethyl acrylate with B.E.E. (3%) pressed prior to exposure | 50 | 48 | 45 |
| 9. | Epoxy acrylate prepolymer DH 304 | 43 | 41 | 41 |
| 10. | Epoxy acrylate prepolymer DH 304 with B.E.E. (3%) and pressed prior to exposure | 44 | 43 | 43 |
| 11. | Epoxy acrylate prepolymer DH 304 with | | | |

TABLE 10-continued

| Wool - 5M Rad E.B. irradiation | | | |
|---|---|---|---|
| Monomer | weight gain after E.B. and $CCl_4$ extraction (% by weight) | % weight after benzene extraction | % weight after warm detergent extraction |
| B.E.E. (3%) no E.B. treatment | 30 | 25 | 25 |

TABLE 11

| Cotton - 5M Rad E.B. irradiation | | | |
|---|---|---|---|
| Monomer | weight gain after E.B. and $CCl_4$ extraction (% by weight) | % weight after benzene extraction | % weight after warm detergent extraction |
| 1. Acrylic Acid | 51 | 50 | 34 |
| 2. Acrylic acid with B.E.E. (3%) | 53 | 52 | 33 |
| 3. Acrylic acid with B.E.E. (3%) no E.B. treatment | 29 | 28 | 9 |
| 4. Acrylic acid B.E.E. (5%) pressed prior to exposure | 60 | 59 | 34 |
| 5. 2 hydroxy ethyl acrylate | 40 | 39 | 35 |
| 6. 2 hydroxy ethyl acrylate with B.E.E. (3%) | 41 | 40 | 35 |
| 7. 2 hydroxy ethyl acrylate with B.E.E. (3%) no E.B. treatment | 29 | 28 | 15 |
| 8. 2 hydroxy ethyl acrylate with B.E.E. (3%) pressed prior to exposure | 42 | 41 | 36 |
| 9. Epoxy acrylate prepolymer DH 304 | 40 | 40 | 40 |
| 10. Epoxy acrylate prepolymer DH 304 with B.E.E. (3%) and pressed prior to exposure | 41 | 40 | 39 |
| 11. Epoxy acrylate prepolymer DH 304 with B.E.E. (3%) no E.B. treatment | 31 | 30 | 25 |

TABLE 12

| Polyester - 5M Rad E.B. irradiation | | | |
|---|---|---|---|
| Monomer | weight gain after E.B. and $CCl_4$ extraction (% by weight) | % weight after benzene extraction | % weight after warm detergent extraction |
| 1. Acrylic Acid | 31 | 26 | 13 |
| 2. Acrylic acid with B.E.E. (3%) | 41 | 36 | 18 |
| 3. Acrylic acid with B.E.E. (3%) no E.B. treatment | 18 | 15 | 5 |
| 4. Acrylic acid B.E.E. (5%) pressed prior to exposure | 44 | 38 | 18 |
| 5. 2 hydroxy ethyl acrylate | 27 | 24 | 20 |
| 6. 2 hydroxy ethyl acrylate with B.E.E. (3%) | 30 | 27 | 24 |
| 7. 2 hydroxy ethyl acrylate with B.E.E. (3%) no E.B. treatment | 16 | 15 | 8 |
| 8. 2 hydroxy ethyl acrylate with B.E.E. (3%) pressed prior to exposure | 32 | 27 | 25 |
| 9. Epoxy acrylate prepolymer DH 304 | 27 | 24 | 22 |
| 10. Epoxy acrylate prepolymer DH 304 with B.E.E. (3%) and pressed prior to exposure | 17 | 15 | 13 |

TABLE 13

| Nylon - 5M Rad E.B. irradiation | | | |
|---|---|---|---|
| Monomer | weight gain after E.B. and $CCl_4$ extraction (% by weight) | % weight after benzene extraction | % weight after warm detergent extraction |
| Acrylic Acid | 35 | 30 | 19 |
| Acrylic acid with B.E.E. (3%) | 36 | 32 | 20 |
| Acrylic acid with B.E.E. (3%) no E.B. treatment | 19 | 18 | 10 |
| 2 hydroxy ethyl acrylate | 29 | 28 | 20 |
| 2 hydroxy ethyl acrylate with B.E.E. (3%) | 30 | 28 | 20 |
| 2 hydroxy ethyl acrylate with B.E.E. (3%) no E.B. treatment | 20 | 18 | 12 |

Table 14 shows the grafting of a number of monomers to a variety of substrates under I M Rad E.B. irradiation with in each case a comparative example which received no E.B. irradiation.

TABLE 14

| Substrate | Monomer/Prepolymer | 1M Rad E.B. irradiations weight gain after E.B. and $CCl_4$ extraction | % weight after warm detergent extraction |
|---|---|---|---|
| Wool | Acrylic Acid | 75 | 55 |
| " | Acrylic Acid no E.B. treatment | | 0 |
| " | 2 hydroxy ethyl acrylate | 70 | 65 |
| " | 2 hydroxy ethyl acrylate no E.B. treatment | | 0 |
| Cotton | Acrylic Acid | 60 | 39 |
| " | Acrylic Acid no E.B. treatment | | 1 |
| " | 2 hydroxy ethyl acrylate | 60 | 53 |
| " | 2 hydroxy ethyl acrylate no E.B. treatment | | 0 |
| Polyester | Acrylic Acid | 25 | 6 |
| " | Acrylic acid no E.B. treatment | | 3 |
| " | 2 hydroxy ethyl acrylate | 25 | 19 |
| " | 2 hydroxy ethyl acrylate no E.B. treatment | | 0 |
| " | 2 hydroxy ethyl acrylate + B.E.E. | 25 | 23 |
| " | 2 hydroxy ethyl acrylate + B.E.E. no E.B. treatment | | 0 |

Table 15 shows the grafting of a number of prepolymers to a variety of substrates under I M Rad E.B. irradiation with in each case a comparative example which received no E.B. irradiation.

TABLE 15

| Substrate | Prepolymer | 1M Rad E.B. irradiation weight gain after E.B. and $CCl_4$ extracted | % weight after warm detergent extraction |
|---|---|---|---|
| Wool | epoxy acrylate DH304 Shell | 50 | 45 |
| " | epoxy acrylate DH304 Shell no E.B. treatment | | 0 |
| Polyester | epoxy acrylate DH304 Shell | 50 | 44 |
| " | epoxy acrylate DH304 Shell no E.B. treatment | | 3 |
| Nylon | epoxy acrylate DH304 Shell | 50 | 47 |
| " | epoxy acrylate DH304 Shell no E.B. treatment | | 2 |
| Cotton | urethane acrylate ZL788 THIOKOL Corp. | 55 | 55 |
| " | urethane acrylate ZL788 THIOKOL Corp. no E.B. treatment | | 0 |
| Polyester | urethane acrylate ZL788 THIOKOL Corp. | 50 | 43 |
| " | urethane acrylate ZL788 THIOKOL Corp. no E.B. treatment | | 0 |
| Cotton | urethane acrylate "Chempol" Freeman Corp. | 55 | 54 |
| " | urethane acrylate "Chempol" Freeman Corp. no E.B. treatment | | 0 |
| Polyester | urethane acrylate "Chempol" Freeman Corp. | 40 | 29 |
| " | urethane acrylate "Chempol" Freeman Corp. no E.B. treatment | | 0 |
| " | urethane acrylate Witco Company | 80 | 80 |
| " | urethane acrylate Witco Co. no E.B. treatment | | 0 |
| " | urethane acrylate Purelast 186 Polymer Systems Corp. | 50 | 30 |
| " | urethane acrylate Purelast 186 Polymer Systems Corp. no E.B. treatment | | 2 |

Table 16 shows the grafting of monomers and prepolymers to orlon, viscose and nylon using U.V. radiation. These runs were carried out in the same manner as the runs recorded in Table 1.

TABLE 16

| | Polymer uptake after curing | Polymer lost after $CCl_4$ wash (%) |
|---|---|---|
| Sample: Orlon | | |
| 1. Acrylic acid | 41.1 | −2.0 |
| 2. N Methylol acrylamide | 36.3 | −2.1 |
| 3. Epoxy acrylate DOWEX 80 | 62.4 | −12.2 |
| 4. Urethane acrylic acid | 37.0 | −4.0 |
| 5. Urethane acrylate "Chempol" | 36.7 | 0.0 |
| Sample: Viscose | | |
| 1. Acrylic acid | 50.3 | 0.0 |

TABLE 16-continued

| | Polymer uptake after curing | Polymer lost after $CCl_4$ wash (%) |
|---|---|---|
| 2. N Methylol acrylamide | 40.0 | 0.0 |
| 3. Epoxy acrylate DOWEX 80 | 61.1 | 0.0 |
| 4. Urethane acrylic acid | 48.4 | 0.0 |
| 5. Urethane acrylate "Chempol" | 40.6 | 0.0 |
| Sample: Nylon | | |
| 1. Acrylic acid | 43.8 | 0.0 |
| 2. N Methylol acrylamide | 41.2 | 0.0 |
| 3. Epoxy acrylate DOWEX 80 | 56.1 | −1.0 |
| 4. Urethane acrylic acid | 51.4 | 0.0 |
| 5. Urethane acrylate "Chempol" | 47.1 | 0.0 |

The U.V. results reported above were achieved using an unfocussed lamp. Much faster cure times were achieved using a suitably focussed lamp. Table 17 shows results achieved in grafting Shell DH304 epoxy acrylate onto polyester cotton and wool fabrics by the process described with reference to Table 1.

TABLE 17

| U.V. Curing with Focussed Lamp 1/20 sec. Epoxy Acrylate DH304 Shell | | |
|---|---|---|
| Substrate | Weight Gain After U.V. | Percentage lost on extraction with $CCl_4$ |
| Polyester | 14 | −1 |
| Cotton | 26 | −3 |
| Wool | 16 | −4 |

The results given above for the weight gain after application of a monomer or prepolymer and irradiation do not represent a measure of grafting efficiency as the amount of monomer or polymer applied to the substrate varied from case to case. The results do clearly show that good permanent press characteristics can be achieved using certain monomers and prepolymers which are resistant to removal with organic and aqueous solvents.

The unirradiated comparative samples do show some degree of take up by the substrate fabrics particularly in the presence of BEE. This is due to curing of the monomer by natural light present in the laboratory in which the experiments were carried out.

All of the textile articles treated with monomer or monomer solutions or with prepolymers falling within the scope of the present invention showed substantial permanent press characteristics. The samples treated with diethylamino ehtyl methacrylate showed the sharpest and most rigid permanent press characteristics of the monomers tested. In general the prepolymer treated textile articles showed better permanent press characteristics than the monomer treated textile articles.

It will be recognised by persons skilled in the art that numerous variations and modifications may be made to the invention as described above without departing from the spirit or scope of the invention as broadly described.

The claims defining the invention are defined as follows:

1. A method for imparting permanent press characteristics to textile articles without using textile resins and textile resin catalysts comprising the steps of:

(a) applying to the textile article, at least in the area to be creased and pressed, a urethane acrylate prepolymer or an epoxy acrylate prepolymer or an acrylated polyester prepolymer;

(b) curing the prepolymer in situ on the textile article using ultraviolet radiation or an electron beam; and (c) pressing the textile article along a crease after the application of the prepolymer and after the curing of the prepolymer.

2. A method as claimed in claim 1, in which a water soluble monomer having a molecular weight less than 300 and selected from the group comprising acrylic acid, methacrylic acid, substituted acrylic and methacrylic acids, esters and substituted esters of acrylic acid and methacrylic acid, and amides and substituted amides of acrylic acid and methacrylic acid, or a prepolymer of any one or more of these monomers is applied to the textile article together with the urethane acrylate prepolymer, epoxy acrylate prepolymer or acrylated polyester prepolymer.

3. A method as claimed in claim 2, in which the molecular weight of the monomer does not exceed 200.

4. A method as claimed in claim 2, in which the molecular weight of the monomer does not exceed 150.

5. A method as claimed in claim 2 or 4, in which the monomers are selected from the group comprising acrylic acid, diethylamino ethyl methacrylate, hydroxy acrylate, hydroxy propyl acrylate, N-methylol acrylamide, 2-hydroxy ethyl methacrylate and diethyl amino ethyl acrylate.

6. A method as claimed in claim 2 which the monomers are applied to the textile article from an aqueous or alcoholic solution.

7. A method as claimed in claim 1, in which the prepolymers are formed by ultra-violet or ionising radiation.

8. A method as claimed in claim 1, in which the prepolymer is applied to both faces of the textile article in the area to be creased.

9. A method as claimed in claim 1, in which both faces of the textile article are subjected to the ultra-violet radiation or electron beam in the area to which the prepolymer has been applied.

* * * * *